US010384467B2

(12) United States Patent
Piccirilli

(10) Patent No.: US 10,384,467 B2
(45) Date of Patent: Aug. 20, 2019

(54) SUBLIMATION PRINTING ON A FABRIC CONTAINING COTTON AND/OR VISCOSE

(71) Applicant: ENGLER ITALIA S.R.L., Casnate con Bernate (CO) (IT)

(72) Inventor: Bruno Piccirilli, Casnate con Bernate (IT)

(73) Assignee: ENGLER ITALIA S.R.L., Casnate con Bernate (CO) (IT)

( * ) Notice: Subject to any disclaimer, the term of this patent is extended or adjusted under 35 U.S.C. 154(b) by 100 days.

(21) Appl. No.: 15/318,602

(22) PCT Filed: Jul. 16, 2015

(86) PCT No.: PCT/IB2015/055378
§ 371 (c)(1),
(2) Date: Dec. 13, 2016

(87) PCT Pub. No.: WO2016/016757
PCT Pub. Date: Feb. 4, 2016

(65) Prior Publication Data

US 2017/0129255 A1 May 11, 2017

(30) Foreign Application Priority Data

Jul. 30, 2014 (IT) ..... CO2014A0024

(51) Int. Cl.
*B05D 1/02* (2006.01)
*B41J 2/01* (2006.01)
(Continued)

(52) U.S. Cl.
CPC ..... *B41J 3/4078* (2013.01); *B05D 1/02* (2013.01); *B41J 2/01* (2013.01); *D06P 3/60* (2013.01);
(Continued)

(58) Field of Classification Search
CPC ..... B05D 1/02; B41M 5/0256; B41M 5/035; B41J 2/01; B41J 3/4078; D06P 3/60;
(Continued)

(56) References Cited

U.S. PATENT DOCUMENTS 4,021,591 A 5/1977 DeVries et al.
4,576,610 A 3/1986 Donenfeld
(Continued)

FOREIGN PATENT DOCUMENTS

DE 2847702 A1 5/1980
GB 1584795 A * 2/1981 ..... B41M 3/12

OTHER PUBLICATIONS

Translation of DE2847702.*

*Primary Examiner* — Sonya M Sengupta
(74) *Attorney, Agent, or Firm* — King & Schickli, PLLC

(57) ABSTRACT

A sublimation printing method on cotton and/or viscose is described comprising the steps of: preparing a piece of laminar substrate, applying (for example) microcapsules onto a side of said piece of laminar substrate, wherein said microcapsules comprise a core of polyester and/or polyamide and/or polyethylene and a shell of cellulose and/or starch, ink-jet printing onto said side of said piece of laminar substrate using sublimation ink, preparing a piece of fabric containing a high amount of cotton and/or viscose, approaching said piece of laminar substrate and said piece of fabric, pressing and heating, and separating said piece of laminar substrate from said piece of fabric; a fabric ready for sublimation printing is obtained if the step of ink-jet printing is not performed.

16 Claims, 2 Drawing Sheets

(51) Int. Cl.

| | |
|---|---|
| ***D06P 3/60*** | (2006.01) |
| ***D06P 5/28*** | (2006.01) |
| ***B41J 3/407*** | (2006.01) |
| ***B41M 5/025*** | (2006.01) |
| ***B41M 5/035*** | (2006.01) |

(52) U.S. Cl.
CPC ..... *D06P 5/004* (2013.01); *B41M 5/0256* (2013.01); *B41M 5/035* (2013.01)

(58) Field of Classification Search
CPC ..... D06P 5/004; D06P 1/5221; D06P 1/5271; D06P 1/5278; D06P 1/5285; D06P 3/32; D06P 5/006; D06P 5/205; D06P 5/2055; D06P 5/2066; D06P 5/2072; D06P 5/30
USPC ..... 156/230, 277, 289
See application file for complete search history.

(56) References Cited

U.S. PATENT DOCUMENTS

| | | | | |
|---|---|---|---|---|
| 5,575,877 | A | 11/1996 | Hale et al. | |
| 6,652,928 | B2 * | 11/2003 | Sato | B41M 5/0256 347/105 |
| 7,081,324 | B1 | 7/2006 | Hare et al. | |
| 2004/0218028 | A1 * | 11/2004 | Furukawa | B41J 2/0057 347/101 |
| 2017/0218565 | A1 * | 8/2017 | Loccufier | D06P 5/30 |

* cited by examiner

SUBLIMATION PRINTING ON A FABRIC CONTAINING COTTON AND/OR VISCOSE

FIELD OF THE INVENTION

The present invention primarily relates to a sublimation printing method on a fabric containing cotton and/or viscose, and a fabric printed by said method.

Secondarily, the present invention also relates to a preliminary treatment method of a fabric containing cotton and/or viscose such as to allow the subsequent sublimation printing, and a fabric treated by said method.

PRIOR ART

Sublimation printing is a known low-cost printing method, which provides excellent results when performed on synthetic material fabrics, particularly plastic-based fabric. "Sublimation inks" are used for such a method, so called because they sublimate during the printing method.

Poor results are obtained if such a method is used on fabrics containing cotton and/or viscose, because the pigments of commercial sublimation inks do not fix satisfactorily or stably to these natural fibers.

Therefore, such a method is generally not used for fabrics containing cotton and/or viscose.

SUMMARY

In view of the advantages of sublimation printing, the present inventors have researched a solution allowing it to be used also on fabrics containing cotton and/or viscose.

Said object has been achieved by the methods of the appended claims, which are an integral part of the present description.

The solution underlying the present invention is the treatment of the fabric containing cotton and/or viscose with polyester and/or polyamide and/or polyethylene; in this way, the pigments of the sublimation ink can fix to the polyester and/or polyamide and/or polyethylene, and as a consequence to the cotton and/or viscose.

More specifically, the treatment with polyester and/or polyamide and/or polyethylene may be performed by means of microcapsules containing a core of polyester and/or polyamide and/or polyethylene (which melts if heated to a suitable temperature) and a shell of cellulose and/or starch (which desegregates if heated to a suitable temperature).

In general, the following steps are provided: preparing a piece of laminar substrate, applying microcapsules onto a side of said piece of laminar substrate, wherein said microcapsules comprise a core of polyester and/or polyamide and/or polyethylene and a shell of cellulose and/or starch, ink-jet printing onto said side of said piece of laminar substrate by using sublimation ink, preparing a piece of fabric containing a high amount of cotton and/or viscose, approaching said piece of laminar substrate and said piece of fabric, pressing and heating, and separating said piece of laminar substrate from said piece of fabric.

To simplify the process, polyester and/or polyamide and/or polyethylene may be applied to the laminar substrate in the form of resin mixed with other substances, i.e. without being microencapsulated.

A fabric ready for sublimation printing is obtained if the step of ink-jet printing is not performed.

Subjects of the present invention are also fabrics treated or printed according to said methods.

LIST OF FIGURES

The characteristics and the advantages of the present invention will become apparent from the following detailed description, from the working examples provided for illustrative purposes, and from the annexed Figures wherein.

Figures 1A, 1B:
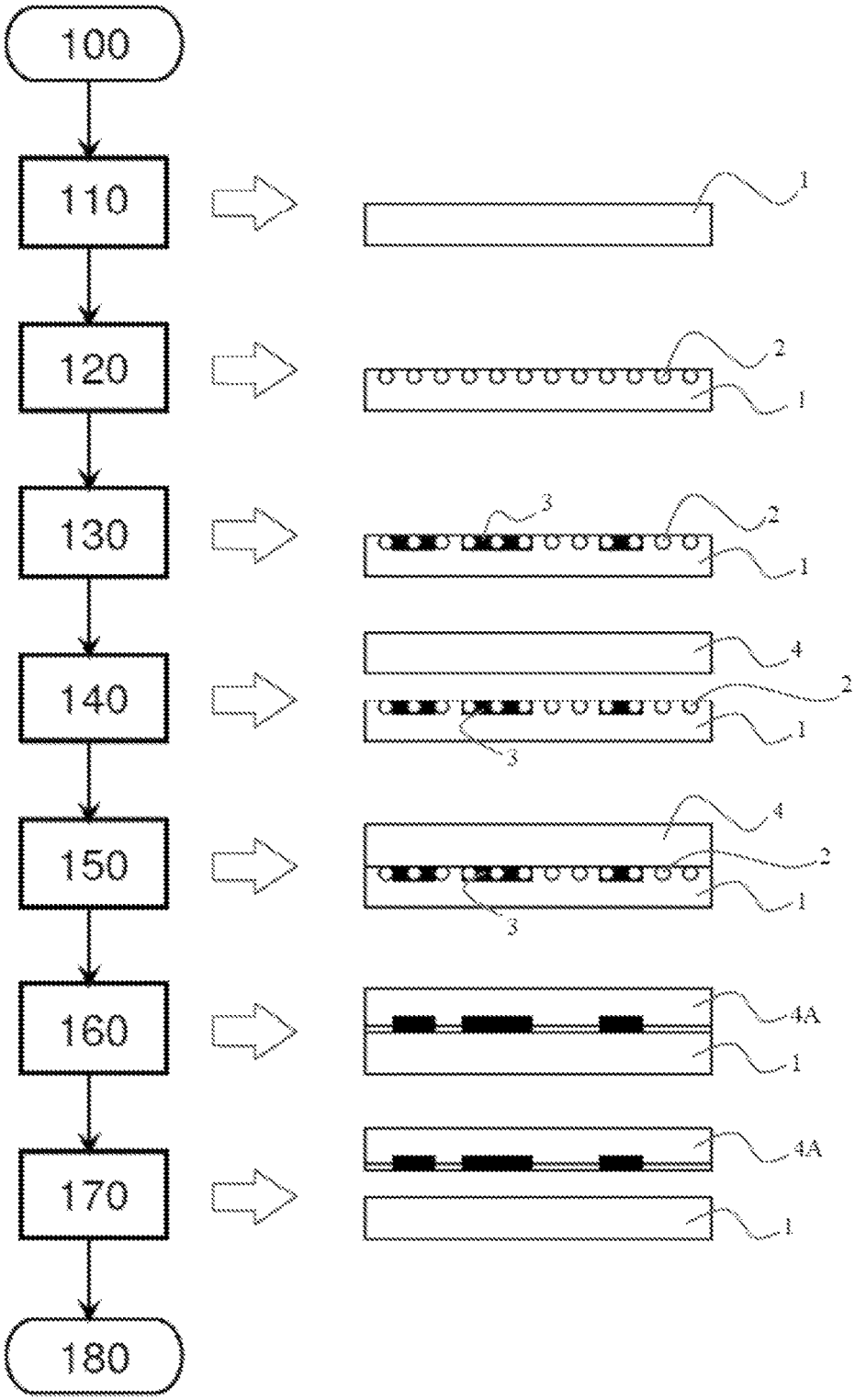
FIG. 1A shows a flow chart related to an embodiment of a printing method according to the present invention.
FIG. 1B shows a series of images related to the steps of the method in FIG. 1A.

All these figures refer to the same embodiment.

As easily apparent, the present invention, whose main advantageous aspects are defined in the appended claims, can be implemented and applied in various manners in practice.

DETAILED DESCRIPTION

A sublimation printing method will be illustrated hereinafter with reference to FIG. 1; the method starts with block 100 and ends with block 180.

Said method is advantageously used to print fabric containing a high amount of cotton and/or viscose. 'High amount' usually means that the fabric contains cotton and/or viscose for at least 50% of its weight; typical cases are, for example: fabric entirely (or nearly entirely, i.e. more than 90%) made of cotton, fabric entirely (or nearly entirely, i.e. more than 90%) made of viscose, fabric entirely (or nearly entirely, i.e. more than 90%) made of viscose and cotton (in variable parts).

The steps of the method are described below and typically performed in sequence:

step 110: preparing a piece of laminar substrate, step 120: applying microcapsules onto a side of said piece of laminar substrate, wherein said microcapsules comprise a core of polyester and/or polyamide and/or polyethylene and a shell of cellulose and/or starch, step 130: ink-jet printing onto said side of said piece of laminar substrate by using sublimation ink, step 140: preparing a piece of fabric containing a high amount of cotton and/or viscose, and possibly moistening it, step 150: approaching said piece of laminar substrate and said piece of fabric, step 160: pressing and heating, and step 170: separating said piece of laminar substrate and said piece of fabric.

A person skilled in the art will appreciate that the innovative method described above is similar to a traditional printing sublimation printing method; therefore, the printing of step 130 is advantageously performed by means of a moveable head.

It substantially differs for step 120. Typically, the microcapsules of step 120 precisely only consist of a core made of polyester and/or polyamide and/or polyethylene and a shell made of cellulose and/or starch.

The approaching in step 150 and the pressuring in step 160 cause a close contact between substrate and fabric. The heating in step 160 acts on the substrate and on the fabric simultaneously. During step 160, cellulose and/or starch disaggregate, the polyester and/or polyamide and/or polyethylene melt and are transferred onto the fabric, the ink sublimates and is transferred onto the fabric "impregnated" (on one side) with polyester and/or polyamide. A high quality printing is thus obtained.

Typically, the microcapsules are uniformly applied on the substrate, and thus the entire side of the fabric is uniformly treated.

However, it cannot be excluded that only some areas of the fabric are selectively treated with polyester and/or polyamide and/or polyethylene, in particular those to be printed i.e. intended to receive the sublimation ink.

The piece of laminar substrate may derive, for example, from a paper material mixture or from an extrusion of plastic material, in particular polypropylene.

The piece of laminar substrate may be in the form of sheet or strip (e.g. unwound before the printing method and wound back after the printing method).

The application of microcapsules may be performed in many manners. It may be performed by means of a physical microcapsule conveying process, or by means of an electrical microcapsule conveying process, or by spreading of a material containing microcapsules, or by spraying of a material containing microcapsules; an aqueous suspension of microcapsules can be used for spreading and spraying.

The step of pressing and heating (step 160 in FIG. 1) may last, for example, for a predetermined time, in particular from 30" to 90".

The heating during the step of printing and heating (step 160 in FIG. 1) is preferably at a temperature of 180° C.-220° C.

The diameter of the core of the microcapsules may be, for example, 30-60 microns.

The thickness of the shell of the microcapsules may be, for example, 10-30 microns.

A piece of printed fabric is obtained at the end of the method described above.

In the method described above, the treatment of the fabric and the printing occur nearly simultaneously.

However, according to a variant of the present invention, the treatment of the fabric and the printing of the fabric may also occur at very different times.

With reference to the printing method described above, the treatment method differs for the fact that step 130 is not performed.

This variant, i.e. the method without step 130A, may be considered a preliminary treatment of fabric containing cotton and/or viscose for subsequent sublimation printing, wherein a piece of laminar substrate is prepared and polyester and/or polyamide and/or polyethylene is applied onto a side of said piece of laminar substrate. A piece of treated fabric is obtained at the end of such a preliminary treatment method.

Such a piece of treated fabric, which can be obtained in steps 110)-120)-140)-150)-160)-170) of the method described above, can then be subjected to a traditional sublimation printing method which corresponds, for example, to the method in FIG. 1 in which step 120 is not performed.

As mentioned, to simplify the process, polyester and/or polyamide and/or polyethylene may be applied to the laminar substrate in the form of resin mixed with other substances, i.e. without being microencapsulated.

Such an application may be obtained, for example, by spreading (flexography printing or air knife printing or other type) of a product, the formulation of which contains a polyester resin and/or a polyamide resin and/or a polyethylene resin.

The use of microcapsules implies greater production costs, but allows to make the polyester and/or polyamide and/or polyethylene penetrate in the fabric in greater depth and thus to obtain better quality prints afterward.

As mentioned, FIG. 1 shows an embodiment of the invention.

More generally, the method described above comprises the steps of:

a) providing a piece of laminar substrate, b) applying a polymeric material comprising polyester, polyamide, polyurethane, polyethylene or a mixture thereof onto a side of said laminar substrate, d) providing cotton and/or viscose, e) hot pressing said side of the laminar substrate onto said cotton and/or viscose, and f) separating the laminar substrate from cotton and/or viscose, wherein, a step c) of ink-jet printing with sublimation ink on said side of the laminar substrate is provided between step b) and step d), or alternatively a step g) of ink-jet printing with sublimation ink on cotton and/or viscose is provided after step f).

As mentioned, the method exploits the sublimation process which allows to transfer the sublimation ink directly onto cotton and/or viscose, by means of a hot pressing or a calender. During heating, the ink by coming into contact with the polymeric material is combined, substantially instantaneously, with cotton and/or viscose in nearly permanent manner. The method allows to obtain cotton and/or viscose printed without any relief or thickness, which is washable without altering the typical texture of cotton and/or viscose. The devices used for digital transfer printing, such as a printer provided with sublimation inks and press or calender of suitable size for hot transfer to the product to be printed, are appropriate for implementing the method according to the invention.

In step a) of the method according to the invention, a laminar substrate is provided.

"Laminar substrate" means any substrate suitable for sublimation printing and thus suitable to be used in a hot press or a calender.

Preferably, said laminar substrate is in the form of sheet or strip, and comprises paper, plastic material or a combination thereof.

Suitable plastic materials are polyester, polyethylene terephthalate (PET), polyethylene terephthalate glycol-modified (PETG) and polyethylene terephthalate film (PETF) and combinations thereof.

In the preferred embodiments, said laminar substrate is paper.

In step b), a polymeric material comprising polyester, polyamide, polyurethane, polyethylene or a mixture thereof is applied onto a side of said laminar substrate.

Preferably, said polymeric material is a polymeric adhesive.

In preferred embodiments, said polymeric material comprises polyester and/or polyamide and/or polyethylene, i.e. polyester, polyamide, polyethylene or a mixture thereof; more preferably, said polymeric material comprises LDPE, HDPE, copolyester, copolyamide or a mixture thereof.

The application of the polymeric material depends on the pattern of the finished printing to be obtained; therefore, the polymeric material may be applied on the entire side of the laminar substrate or only on one part or several parts thereof.

The polymeric material may be applied by known methods, such as spreading, flexography printing, rotogravure or silk-screen printing.

The amount of polymeric material is preferably applied on the side of the laminar substrate in an amount so as to result in 10-50 g/m$^2$ (dry measure), more preferably 15-30 g/m$^2$.

The expression "dry measurement" means that the indicated amount is measured at the end of step b) of applying the polymeric material after the latter has dried on the laminar substrate.

In preferred embodiments, the polymeric material is microencapsulated. In particular, it is encapsulated in microcapsules each having a total diameter of 40-100 μm. "Diameter" means the average diameter of the microcapsules, i.e. of the polymeric material core and shell containing the same.

Indeed, it has been found that the microcapsules offer a better degree of surface penetration of the polymeric material, so as to greatly improve the finished printing quality and definition.

In these preferred embodiments, step b) of applying said polymeric material on a side of said laminar substrate may be performed by physical conveying the encapsulated polymeric material, or by electrical conveying of the encapsulated polymeric material, or by spreading a resin containing the encapsulated polymeric material, or by spraying a resin containing the encapsulated polymeric material.

When a resin containing microencapsulated polymeric material is used, it may comprise dispersant agents, nonionic surfactants, Teflon-coated waxes or mixtures thereof.

The microcapsules may be prepared according to known microencapsulation methods, preferably by using cellulose, starch or a mixture thereof for the outer shell of the microcapsules.

More preferably, the polymeric material microcapsules have a shell made of cellulose, starch or a mixture thereof, said shell having a thickness of 10-30 μm.

In step d) of the method, cotton and/or viscose is provided.

Said cotton and/or viscose may be in the form of a scrap, remnant, tape, band or finished product to be printed.

In step e) of the method, hot pressing the side of the laminar substrate on cotton and/or viscose is performed.

In particular, the side of the laminar substrate treated during step b) is hot pressed by means of a press or a calender directly on cotton and/or viscose for a very short time.

Preferably, said pressing is performed at a temperature of 180° C.-220° C.

Preferably, said interval of time is 30-90 seconds.

After step e) of hot pressing, in step f) the laminar substrate is separated by cotton and/or viscose.

Finally, the method of the invention comprises at least one further step chosen from the following two:

a step c), to be performed between step b) and step d), of ink-jet printing with sublimation ink on said side of the laminar substrate, a step g), to be performed after step f), of ink-jet printing with sublimation ink on cotton and/or viscose.

The heating of the pressing step works on laminar substrate and on cotton and/or viscose simultaneously. During step e), the polymeric material melts and transfers onto the cotton and/or viscose surface to be decorated.

If step c) is chosen, cotton and/or viscose at the end of the step f) is already printed, by effect of the sublimation of the ink which is transferred onto the cotton and/or viscose surface at the same time as the polymeric material during step e).

If step g) is chosen, cotton and/or viscose at the end of the step f) is treated and ready to be printed, i.e. the ink is sublimated subsequently on the surface on the polymeric material onto which it was preliminarily transferred. In this case, the variant described above is obtained, i.e. the method without step 130, which may be considered a preliminary treatment method for fabric containing cotton and/or viscose for the subsequent sublimation print.

In this regard, in another aspect, the present invention also relates to cotton and/or viscose treated to be printed by sublimation printing, obtainable by steps a)-b)-d)-e)-f) of the method described above. In this manner, a sort of intermediate semi-finished product is obtained and, if desired, step g) of ink-jet printing with sublimation ink on cotton and/or viscose is postponed to a later time.

In another aspect, the present invention relates to cotton and/or viscose printed by the sublimation printing method described above.

As mentioned, cotton and/or viscose printed according to the invention is washable, maintains its texture and does not show any visible alteration with respect to the initial thickness.

In a further aspect, the present invention relates to a laminar substrate for sublimation printing, said substrate being in the form of sheet or strip comprising paper, plastic material or a combination thereof, wherein polymeric material comprising polyester, polyamide, polyurethane, polyethylene or a mixture thereof is present on one side of the laminar substrate.

As mentioned above, the polymeric material may be applied on a side of said laminar substrate by physical conveying the microencapsulated polymeric material, or by electrical conveying the microencapsulated polymeric material, or by spreading a resin containing microencapsulated polymeric material, or by spraying a resin containing the microencapsulated polymeric material.

When a resin containing microencapsulated polymeric material is used, it may comprise dispersant agents, nonionic surfactants, Teflon-coated waxes or mixtures thereof.

Preferably, in said laminar substrate, said polymeric material is microencapsulated.

The laminar substrate may derive, for example, from a paper material mixture or from an extrusion of plastic material, in particular polyester.

As mentioned, the laminar substrate may be in the form of sheet or strip, and for example may be unwound before the method and wound back after the printing method.

According to a further aspect, the present invention relates to a kit for sublimation printing on cotton and/or viscose, said kit comprising the laminar substrate described above and at least one sublimation ink.

Alternatively, such a kit may comprise cotton and/or viscose treated to be printed by sublimation printing, as described above, and at least one sublimation ink.

It should be understood that all aspects identified as preferred and advantageous for the sublimation printing method should be considered similarly preferred and advantageous for the laminar substrate, cotton and/or viscose to be printed, kits, as well as cotton and/or viscose printed by said sublimation printing method.

It should be also understood that all the combinations of preferred aspects of the sublimation printing method, laminar substrate, cotton and/or viscose treated to be printed, kits, as well as cotton and/or viscose printed by the sublimation printing method, as above reported, are to be deemed as hereby disclosed.

Below is a working example of the present invention provided for illustrative purposes.

Example 1

Sublimation Printing of Cotton According to the Present Invention

A remnant of white cotton having a surface area of approximately 50 $cm^2$ and a sheet of paper having substantially the same surface area are provided.

FIG. 1 shows a series of simplified sections, one section for each step of the method of the invention.

Microcapsules (2) containing polyester (outer shell of cellulose and starch) were applied by means of a spreading bar on one side of the paper sheet (1). The microcapsules had a total diameter of 60 μm and were dispersed in a cationic acrylic resin (pH 5) which facilitated the spreading on the sheet of paper. An amount of microcapsules were applied on the sheet of paper so as to result in 16-20 g/m$^2$ (as a dry measurement).

The same side of the paper sheet was then ink-jet printed with sublimation ink (3), following the desired final pattern.

The side of the paper sheet thus treated was faced to the surface of the cotton remnant (4) to be decorated and then pressed together at a temperature of approximately 190° C. for 50 seconds. In this manner, the ink sublimated nearly instantaneously on the cotton thus decorating it (4A) as desired.

Sheet and printed cotton were then separated, showing a perfectly defined, brilliant color print on the surface of the cotton.

Figure 2:
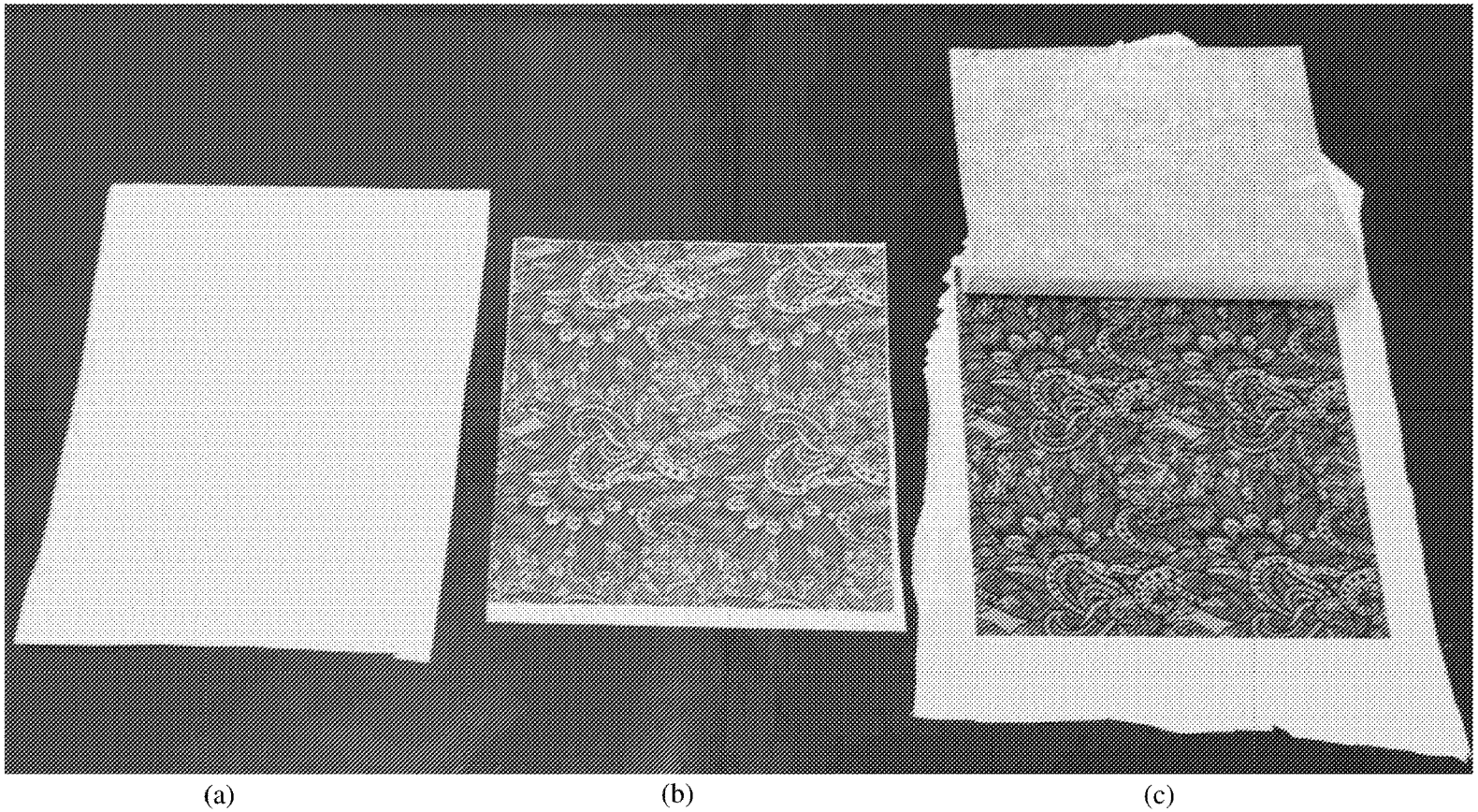
FIG. 2 shows a series of images related to Example 1.

With reference to FIG. 2, the paper sheet on which the microcapsules were applied initially appeared as shown in FIG. 2(*a*); once ink-jet printed with sublimation ink, the paper sheet assumed the preselected image as shown in FIG. 2(*b*), image which was logically specular to that to be obtained on the cotton; FIG. 2(*c*) shows the printed cotton remnant and the paper sheet used.

The invention claimed is:

1. A sublimation printing method on fabric containing cotton and/or viscose, wherein a piece of laminar substrate is prepared, and polyester and/or polyamide and/or polyethylene is applied onto a side of said piece of laminar substrate before ink-jet printing onto said side of said piece of laminar substrate, said method comprising the steps of:

a) applying a polymeric material comprising polyester, polyamide, polyurethane, polyethylene or a mixture thereof onto a side of said laminar substrate, wherein the polymeric material is microencapsulated, thus providing polymeric material microcapsules comprising a shell of cellulose and/or starch, c) providing cotton and/or viscose, d) hot pressing said side of the laminar substrate onto said cotton and/or viscose, and e) separating the laminar substrate from cotton and/or viscose, wherein, a step b) ink-jet printing with sublimation ink on said side of the laminar substrate is provided between step a) and step c), or alternatively a step f) ink-jet printing with sublimation ink on cotton and/or viscose is provided after step e).

2. The method according to claim 1, wherein said piece of laminar substrate derives from a mixture of paper material or from extrusion of plastic material, and is in the form of sheet or strip.

3. The method according to claim 1, wherein said microcapsule application is performed by means of a physical microcapsule conveying process, or by means of an electrical microcapsule conveying process, or by spreading of a material containing microcapsules, or by spraying of a material containing microcapsules.

4. The method according to claim 1, wherein said hot pressing lasts for a predetermined time of 30 seconds to 90 seconds, and/or wherein said heating is at a temperature of 180° C.-220° C.

5. The method according to claim 1, wherein the diameter of a core of said microcapsules is 30-60 microns.

6. The method according to claim 1, wherein the thickness of the shell of said microcapsules is 10-30 microns.

7. A fabric containing cotton and/or viscose printed according to claim 1.

8. The method according to claim 1, wherein the polymeric material is a polymeric adhesive.

9. The method according to claim 1, wherein the polymeric material is applied on the side of the laminar substrate in an amount so as to result in 10-50 g/m$^2$, as measured at the end of step a) of applying the polymeric material after the latter has dried on the laminar substrate.

10. The method according to claim 1, wherein the polymeric material microcapsules have a shell made of cellulose, starch or a mixture thereof, said shell having a thickness of 10-30 μm.

11. The method according to claim 1, wherein in step e), said hot pressing is performed at a temperature of 180° C.–220° C. for 30-90 seconds.

12. Cotton and/or viscose treated to be printed by sublimation printing, as obtained by the method according to claim 1, or a fabric containing cotton and/or viscose treated according to the method according to claim 1.

13. A kit for implementing the sublimation printing method on fabric containing cotton and/or viscose according to claim 1, said kit comprising:

the piece of laminar substrate, said piece of laminar substrate being in the form of sheet or strip comprising paper, plastic material or a combination thereof, wherein polymeric material comprising polyester, polyamide, polyurethane, polyethylene or a mixture thereof is present on one side of the piece of laminar substrate, and the sublimation ink.

14. A sublimation printing method on fabric containing cotton and/or viscose, wherein a piece of laminar substrate is prepared, and polyester and/or polyamide and/or polyethylene is applied onto a side of said piece of laminar substrate before ink-jet printing onto said side of said piece of laminar substrate, said method comprising the steps of:

applying microcapsules onto a side of said piece of laminar substrate, wherein said microcapsules comprise a core of polyester and/or polyamide and/or polyethylene and a shell of cellulose and/or starch, preparing a piece of fabric containing cotton and/or viscose, approaching said piece of laminar substrate and said piece of fabric, pressing and heating said piece of laminar substrate and said piece of fabric, and separating said piece of laminar substrate and said piece of fabric.

15. A sublimation printing method on fabric containing cotton and/or viscose, wherein a piece of laminar substrate is prepared, and polyester and/or polyamide and/or polyethylene is applied onto a side of said piece of laminar substrate before ink-jet printing onto said side of said piece of laminar substrate, said method comprising the steps of:

applying microcapsules onto a side of said piece of laminar substrate, wherein said microcapsules comprise a core of polyester and/or polyamide and/or polyethylene and a shell of cellulose and/or starch, ink-jet printing onto said side of said piece of laminar substrate using sublimation ink, preparing a piece of fabric containing cotton and/or viscose, approaching said piece of laminar substrate and said piece of fabric, pressing and heating the laminar substrate and piece of fabric, and separating said piece of laminar substrate from said piece of fabric.

16. The method of claim 15, wherein the preparing step comprises moistening the piece of fabric.

* * * * *